US009663282B2

(12) United States Patent
Vogt et al.

(10) Patent No.: US 9,663,282 B2
(45) Date of Patent: May 30, 2017

(54) PACKAGE INTEGRITY INDICATOR FOR CONTAINER CLOSURE

(71) Applicant: Intercontinental Great Brands LLC, East Hanover, NJ (US)

(72) Inventors: Carole Anne Vogt, Budd Lake, NJ (US); Gladys Odette Moncayo, Woodbridge, NJ (US); Jeffrey Thomas Weber, Lake Zurich, IL (US); Elizabeth A. McDermott, Verona, NJ (US); Douglas H. Philipsen, Hackettstown, NJ (US)

(73) Assignee: International Great Rapids LLC, East Hanover, NJ (US)

( * ) Notice: Subject to any disclaimer, the term of this patent is extended or adjusted under 35 U.S.C. 154(b) by 42 days.

(21) Appl. No.: 14/539,429

(22) Filed: Nov. 12, 2014

(65) Prior Publication Data

US 2015/0251829 A1 Sep. 10, 2015

Related U.S. Application Data

(60) Continuation of application No. 14/244,399, filed on Apr. 3, 2014, now Pat. No. 8,951,591, which is a (Continued)

(51) Int. Cl.
*B65D 75/52* (2006.01)
*B65D 75/58* (2006.01)

(Continued)

(52) U.S. Cl.
CPC ..... *B65D 75/522* (2013.01); *B65D 50/00* (2013.01); *B65D 75/5838* (2013.01);

(Continued)

(58) Field of Classification Search
CPC B65D 75/522; B65D 75/5838; B65D 77/206; B65D 77/2096; B65D 2101/00;

(Continued)

(56) References Cited

U.S. PATENT DOCUMENTS 401,974 A 4/1889 Smith
811,092 A 1/1906 Roberts (Continued)

FOREIGN PATENT DOCUMENTS

AU 768679 6/2001
AU 2002334419 B2 5/2003

(Continued)

OTHER PUBLICATIONS

English Translation of JP2006137445 filed by Shimomura, published Jun. 1, 2006, translation provided by the USPTO in U.S. Appl. No. 13/698,567, 18 pages.

(Continued)

*Primary Examiner* — Erik Kashnikow
*Assistant Examiner* — Chaim Smith
(74) *Attorney, Agent, or Firm* — Fitch, Even, Tabin & Flannery

(57) ABSTRACT

A resealable closure for packages is provided which has a package integrity feature. The closure includes a two-ply material having an inner film layer and an outer film layer, forming a top of container. The outer film layer has a sealing panel completely covering a first panel and a second panel of the inner film layer. The sealing panel is permanently attached to the first panel and is releasably affixed a portion of the inner film layer around the perimeter of the first panel to form an opening in the top when the sealing panel with affixed first panel is peeled back from the top. The sealing panel is resealable against the top to seal the opening when the sealing panel is moved back against the top. The package (Continued)

integrity feature comprises the second panel of the inner layer which separates from the sealing panel to indicate that the container has been previously opened.

10 Claims, 5 Drawing Sheets

Related U.S. Application Data continuation of application No. 13/668,425, filed on Nov. 5, 2012, now Pat. No. 8,722,122, which is a division of application No. 11/500,497, filed on Aug. 8, 2006, now Pat. No. 8,308,363, which is a continuation-in-part of application No. 11/438,705, filed on May 23, 2006, now Pat. No. 7,963,413, application No. 14/539,429, which is a continuation of application No. 13/108,582, filed on May 16, 2011, now Pat. No. 8,746,483, which is a division of application No. 11/438,705, filed on May 23, 2006, now Pat. No. 7,963,413.

(51) Int. Cl.
*B65D 77/20* (2006.01)
*B65D 50/00* (2006.01)

(52) U.S. Cl.
CPC ..... *B65D 77/206* (2013.01); *B65D 77/2096* (2013.01); *B65D 2101/00* (2013.01); *B65D 2101/003* (2013.01); *B65D 2575/586* (2013.01); *B65D 2577/205* (2013.01); *B65D 2577/2033* (2013.01); *B65D 2577/2066* (2013.01); *B65D 2577/2091* (2013.01); *Y10T 428/14* (2015.01); *Y10T 428/1495* (2015.01)

(58) Field of Classification Search
CPC ..... B65D 2575/586; B65D 2577/2033; B65D 2577/2091; B65D 50/00; B65D 2101/003
See application file for complete search history.

(56) References Cited

U.S. PATENT DOCUMENTS 1,065,012 A 6/1913 Watanabe
1,106,721 A 8/1914 Lewis
1,171,462 A 2/1916 Rice
1,791,352 A 2/1931 Pascual
1,963,639 A 12/1931 Ahlquist
1,949,161 A 6/1932 Haug
1,978,035 A 9/1932 Thom
1,915,503 A 6/1933 Schmidt
2,033,550 A 3/1936 Rosen
2,034,007 A 3/1936 Elizabeth
2,066,495 A 1/1937 Swift
2,079,328 A 5/1937 McBean
2,128,196 A 8/1938 Max
2,248,578 A 7/1941 Moore
2,260,064 A 10/1941 Stokes
2,320,143 A 5/1943 Johnson
2,321,042 A 6/1943 Preis
2,330,015 A 9/1943 Stokes
2,621,788 A 10/1948 Hitchcock
2,475,236 A 7/1949 Matthew
2,605,897 A 10/1949 Rundle
2,554,160 A 5/1951 Von
2,684,807 A 7/1954 Gerrish
2,719,647 A 10/1955 Olive
2,823,795 A 2/1958 Moore
2,965,224 A 12/1960 Harwood
3,080,238 A 3/1963 Howard
3,127,273 A 3/1964 Monahan
3,179,326 A 4/1965 Underwood
3,186,628 A 6/1965 Rohde
3,187,982 A 6/1965 Underwood
3,217,871 A 11/1965 Lee
3,235,165 A 2/1966 Jackson
3,245,525 A 4/1966 Shoemaker
3,259,303 A 7/1966 Repko
3,260,358 A 7/1966 Gottily
3,272,422 A 9/1966 Miller
3,291,377 A 12/1966 Eggen
3,298,505 A 1/1967 Stephenson
3,311,032 A 3/1967 Lucas
3,326,450 A 6/1967 Langdon
3,331,501 A 7/1967 Stewart
3,343,541 A 9/1967 Bellamy
3,373,922 A 3/1968 Watts
3,373,926 A 3/1968 Voigtman
3,454,210 A 7/1969 Spiegel
3,471,005 A 10/1969 Sexstone
3,520,401 A 7/1970 Richter
3,528,825 A 9/1970 Doughty
3,570,751 A 3/1971 Trewella
3,595,466 A 7/1971 Rosenburg
3,595,468 A 7/1971 Repko
3,618,751 A 11/1971 Rich
3,630,346 A 12/1971 Burnside
3,651,615 A 3/1972 Bohner
3,653,502 A 4/1972 Beaudoin
3,685,720 A 8/1972 Brady
3,687,352 A 8/1972 Kalajian
3,740,238 A 6/1973 Graham
3,740,328 A 6/1973 Rausch
3,757,078 A 9/1973 Conti
3,790,744 A 2/1974 Bowen
3,811,564 A 5/1974 Braber
3,865,302 A 2/1975 Kane
3,885,727 A 5/1975 Gilley
3,905,646 A 9/1975 Brackmann
3,909,582 A 9/1975 Bowen
3,910,410 A 10/1975 Shaw
3,938,659 A 2/1976 Wardwell
3,966,046 A 6/1976 Deutschlander
3,971,506 A 7/1976 Roenna
3,979,050 A 9/1976 Cilia
4,082,216 A 4/1978 Clarke
4,113,104 A 9/1978 Meyers
4,140,046 A 2/1979 Marbach
4,143,695 A 3/1979 Hoehn
4,156,493 A 5/1979 Julius
4,185,754 A 1/1980 Julius
4,192,420 A 3/1980 Worrell, Sr.
4,192,448 A 3/1980 Porth
4,197,949 A 4/1980 Carlsson
4,210,246 A 7/1980 Kuchenbecker
4,258,876 A 3/1981 Ljungcrantz
4,260,061 A 4/1981 Jacobs
4,273,815 A 6/1981 Gifford
4,285,681 A 8/1981 Walitalo
4,306,367 A 12/1981 Otto
4,327,862 A 5/1982 Jakobs
4,337,862 A 7/1982 Suter
4,364,478 A 12/1982 Tuens
4,397,415 A 8/1983 Lisiecki
4,411,365 A 10/1983 Horikawa
4,420,080 A 12/1983 Nakamura
4,428,477 A 1/1984 Cristofolo
4,460,088 A 7/1984 Rugenstein
4,464,154 A 8/1984 Ljungcrantz
4,488,647 A 12/1984 Davis
4,518,087 A 5/1985 Goglio
4,538,396 A 9/1985 Nakamura
4,545,844 A 10/1985 Buchanan
4,548,824 A 10/1985 Mitchell
4,548,852 A 10/1985 Mitchell
4,549,063 A 10/1985 Ang
4,550,831 A 11/1985 Whitford
4,552,269 A 11/1985 Chang
4,557,505 A 12/1985 Schaefer
4,570,820 A 2/1986 Murphy
4,572,377 A 2/1986 Beckett

(56) References Cited

U.S. PATENT DOCUMENTS

| | | | |
|---|---|---|---|
| 4,589,943 | A | 5/1986 | Kimball |
| 4,608,288 | A | 8/1986 | Spindler |
| 4,610,357 | A | 9/1986 | Nakamura |
| 4,613,046 | A | 9/1986 | Kuchenbecker |
| 4,616,470 | A | 10/1986 | Nakamura |
| 4,625,495 | A | 12/1986 | Holovach |
| 4,632,299 | A | 12/1986 | Holmberg |
| 4,638,911 | A | 1/1987 | Prohaska |
| 4,648,509 | A | 3/1987 | Alves |
| 4,651,874 | A | 3/1987 | Nakamura |
| 4,653,250 | A | 3/1987 | Nakamura |
| 4,658,963 | A | 4/1987 | Jud |
| 4,667,453 | A | 5/1987 | Goglio |
| 4,671,453 | A | 6/1987 | Cassidy |
| 4,673,085 | A | 6/1987 | Badouard |
| 4,679,693 | A | 7/1987 | Forman |
| 4,694,960 | A | 9/1987 | Phipps |
| 4,696,404 | A | 9/1987 | Corella |
| 4,709,399 | A | 11/1987 | Sanders |
| 4,723,301 | A | 2/1988 | Chang |
| 4,738,365 | A | 4/1988 | Prater |
| 4,739,879 | A | 4/1988 | Nakamura |
| 4,770,325 | A | 9/1988 | Gordon |
| 4,784,885 | A | 11/1988 | Carespodi |
| 4,786,355 | A | 11/1988 | Kontz |
| 4,790,436 | A | 12/1988 | Nakamura |
| 4,798,295 | A | 1/1989 | Rausing |
| 4,798,296 | A | 1/1989 | Lagerstedt |
| 4,799,594 | A | 1/1989 | Blackman |
| 4,811,848 | A | 3/1989 | Jud |
| 4,818,120 | A | 4/1989 | Addiego |
| 4,838,429 | A | 6/1989 | Fabisiewicz |
| 4,840,270 | A | 6/1989 | Caputo |
| 4,845,470 | A | 7/1989 | Boldt |
| 4,848,575 | A | 7/1989 | Nakamura |
| 4,858,780 | A | 8/1989 | Odaka |
| 4,863,064 | A | 9/1989 | Dailey |
| 4,865,198 | A | 9/1989 | Butler |
| 4,866,911 | A | 9/1989 | Grindrod |
| 4,874,096 | A | 10/1989 | Tessera-Chiesa |
| 4,876,123 | A | 10/1989 | Rivera |
| 4,889,731 | A | 12/1989 | Williams |
| 4,901,505 | A | 2/1990 | Williams, Jr. |
| 4,902,142 | A | 2/1990 | Lammert |
| 4,917,247 | A | 4/1990 | Jud |
| 4,943,439 | A | 7/1990 | Andreas |
| 4,972,953 | A | 11/1990 | Friedman |
| 4,998,666 | A | 3/1991 | Ewan |
| 4,999,081 | A | 3/1991 | Buchanan |
| 5,000,320 | A | 3/1991 | Kuchenbecker |
| 5,001,325 | A | 3/1991 | Huizinga |
| 5,005,264 | A | 4/1991 | Breen |
| 5,010,231 | A | 4/1991 | Huizinga |
| 5,018,625 | A | 5/1991 | Focke |
| 5,029,712 | A | 7/1991 | O'Brien |
| 5,040,685 | A | 8/1991 | Focke |
| 5,046,621 | A | 9/1991 | Bell |
| 5,048,718 | A | 9/1991 | Nakamura |
| 5,054,619 | A | 10/1991 | Muckenfuhs |
| 5,060,848 | A | 10/1991 | Ewan |
| 5,065,868 | A | 11/1991 | Cornelissen |
| 5,076,439 | A | 12/1991 | Kuchenbecker |
| 5,077,064 | A | 12/1991 | Hustad |
| 5,078,509 | A | 1/1992 | Center |
| 5,082,702 | A | 1/1992 | Alband |
| 5,085,724 | A | 2/1992 | Focke |
| 5,096,113 | A | 3/1992 | Focke |
| 5,100,003 | A | 3/1992 | Jud |
| 5,103,980 | A | 4/1992 | Kuchenbecker |
| 5,108,669 | A | 4/1992 | vanDijk |
| 5,124,388 | A | 6/1992 | Pruett |
| 5,125,211 | A | 6/1992 | O'Brien |
| 5,134,001 | A | 7/1992 | Osgood |
| 5,158,499 | A | 10/1992 | Guckenberger |
| 5,161,350 | A | 11/1992 | Nakamura |
| 5,167,455 | A | 12/1992 | Forman |
| 5,167,974 | A | 12/1992 | Grindrod |
| 5,174,659 | A | 12/1992 | Laske |
| 5,184,771 | A | 2/1993 | Jud |
| 5,190,152 | A | 3/1993 | Smith |
| 5,197,618 | A | 3/1993 | Goth |
| 5,222,422 | A | 6/1993 | Benner |
| 5,222,813 | A | 6/1993 | Kopp |
| 5,229,180 | A | 7/1993 | Littmann |
| 5,294,470 | A | 3/1994 | Ewan |
| 5,307,988 | A | 5/1994 | Focke |
| 5,310,262 | A | 5/1994 | Robison |
| 5,333,735 | A | 8/1994 | Focke |
| 5,344,007 | A | 9/1994 | Nakamura |
| 5,352,466 | A | 10/1994 | Delonis |
| 5,356,068 | A | 10/1994 | Moreno |
| 5,366,087 | A | 11/1994 | Bane |
| 5,371,997 | A | 12/1994 | Kopp |
| 5,374,179 | A | 12/1994 | Swanson |
| 5,375,698 | A | 12/1994 | Ewart |
| 5,381,643 | A | 1/1995 | Kazaitis |
| 5,382,190 | A | 1/1995 | Graves |
| 5,388,757 | A | 2/1995 | Lorenzen |
| 5,405,629 | A | 4/1995 | Marnocha |
| 5,407,070 | A | 4/1995 | Bascos |
| 5,409,115 | A | 4/1995 | Barkhorn |
| 5,409,116 | A | 4/1995 | Aronsen |
| 5,439,102 | A | 8/1995 | Brown |
| 5,454,207 | A | 10/1995 | Storandt |
| 5,460,838 | A | 10/1995 | Wermund |
| 5,460,844 | A | 10/1995 | Gaylor |
| 5,461,845 | A | 10/1995 | Yeager |
| 5,464,092 | A | 11/1995 | Seeley |
| 5,470,015 | A | 11/1995 | Jud |
| 5,489,060 | A | 2/1996 | Godard |
| 5,499,757 | A | 3/1996 | Back |
| 5,503,858 | A | 4/1996 | Reskow |
| 5,505,305 | A | 4/1996 | Scholz |
| 5,515,965 | A | 5/1996 | Boldrini |
| 5,519,982 | A | 5/1996 | Herber |
| 5,520,939 | A | 5/1996 | Wells |
| 5,524,759 | A | 6/1996 | Herzberg |
| 5,531,325 | A | 7/1996 | Deflander |
| 5,538,129 | A | 7/1996 | Chester |
| 5,550,346 | A | 8/1996 | Andriash |
| 5,558,438 | A | 9/1996 | Warr |
| 5,582,342 | A | 12/1996 | Jud |
| 5,582,853 | A | 12/1996 | Marnocha |
| 5,582,887 | A | 12/1996 | Etheredge |
| 5,591,468 | A | 1/1997 | Stockley |
| 5,630,308 | A | 5/1997 | Guckenberger |
| 5,633,058 | A | 5/1997 | Hoffer |
| 5,636,732 | A | 6/1997 | Gilels |
| 5,637,369 | A | 6/1997 | Stewart |
| 5,647,100 | A | 7/1997 | Porchia |
| 5,647,506 | A | 7/1997 | Julius |
| 5,664,677 | A | 9/1997 | OConnor |
| 5,672,224 | A | 9/1997 | Kaufmann |
| 5,688,394 | A | 11/1997 | McBride |
| 5,688,463 | A | 11/1997 | Robichaud |
| 5,702,743 | A | 12/1997 | Wells |
| 5,709,479 | A | 1/1998 | Bell |
| 5,725,311 | A | 3/1998 | Ponsi |
| D394,204 | S | 5/1998 | Seddon |
| D394,605 | S | 5/1998 | Skiba |
| 5,749,657 | A | 5/1998 | May |
| 5,770,283 | A | 6/1998 | Gosselin |
| 5,791,465 | A | 8/1998 | Niki |
| 5,795,604 | A | 8/1998 | Wells |
| 5,819,931 | A | 10/1998 | Boucher |
| 5,820,953 | A | 10/1998 | Beer |
| 5,833,368 | A | 11/1998 | Kaufman |
| 5,855,435 | A | 1/1999 | Chiesa |
| 5,862,101 | A | 1/1999 | Haas |
| 5,873,483 | A | 2/1999 | Goertz |
| 5,873,607 | A | 2/1999 | Waggoner |
| 5,882,116 | A | 3/1999 | Backus |
| 5,885,673 | A | 3/1999 | Light |
| 5,906,278 | A | 5/1999 | Ponsi |

(56) References Cited

U.S. PATENT DOCUMENTS

| | | | |
|---|---|---|---|
| 5,908,246 | A | 6/1999 | Arimura |
| 5,928,749 | A | 7/1999 | Forman |
| 5,938,013 | A | 8/1999 | Palumbo |
| 5,939,156 | A | 8/1999 | Rossi |
| 5,945,145 | A | 8/1999 | Narsutis |
| 5,956,794 | A | 9/1999 | Skiba |
| 5,993,962 | A | 11/1999 | Timm |
| 5,996,797 | A | 12/1999 | Flaig |
| 5,997,177 | A | 12/1999 | Kaufman |
| 6,006,907 | A | 12/1999 | Sato |
| 6,012,572 | A | 1/2000 | Heathcock |
| 6,015,934 | A | 1/2000 | Lee |
| 6,026,953 | A | 2/2000 | Nakamura |
| 6,028,289 | A | 2/2000 | Robichaud |
| 6,029,809 | A | 2/2000 | Skiba |
| 6,037,381 | A | 3/2000 | Beer |
| 6,056,141 | A | 5/2000 | Navarini |
| 6,060,095 | A | 5/2000 | Scrimager |
| 6,065,591 | A | 5/2000 | Dill |
| 6,066,437 | A | 5/2000 | Kosslinger |
| 6,076,969 | A | 6/2000 | Jaisle |
| 6,077,551 | A | 6/2000 | Scrimager |
| 6,099,682 | A | 8/2000 | Krampe |
| 6,113,271 | A | 9/2000 | Scott |
| 6,125,614 | A | 10/2000 | Jones |
| 6,126,009 | A | 10/2000 | Shiffler |
| 6,126,317 | A | 10/2000 | Anderson |
| 6,128,317 | A | 10/2000 | Mackre |
| 6,152,601 | A | 11/2000 | Johnson |
| 6,164,441 | A | 12/2000 | Guy |
| 6,213,645 | B1 | 4/2001 | Beer |
| 6,228,450 | B1 | 5/2001 | Pedrini |
| D447,054 | S | 8/2001 | Hill |
| 6,273,610 | B1 | 8/2001 | Koyama |
| 6,279,297 | B1 | 8/2001 | Latronico |
| 6,296,884 | B1 | 10/2001 | Okerfund |
| 6,299,355 | B1 | 10/2001 | Schneck |
| 6,309,104 | B1 | 10/2001 | Koch |
| 6,309,105 | B1 | 10/2001 | Palumbo |
| 6,318,894 | B1 | 11/2001 | Derenthal |
| 6,325,877 | B1 | 12/2001 | Murphy |
| 6,352,364 | B1 | 3/2002 | Mobs |
| 6,364,113 | B1 | 4/2002 | Faasse |
| 6,365,255 | B1 | 4/2002 | Kittel |
| 6,383,592 | B1 | 5/2002 | Lowry |
| 6,402,379 | B1 | 6/2002 | Albright |
| 6,420,006 | B1 | 7/2002 | Scott |
| 6,427,420 | B1 | 8/2002 | Olivieri |
| 6,428,208 | B1 | 8/2002 | Addison |
| 6,428,867 | B1 | 8/2002 | Scott |
| 6,446,811 | B1 | 9/2002 | Wilfong |
| 6,450,685 | B1 | 9/2002 | Scott |
| 6,457,585 | B1 | 10/2002 | Huffer |
| 6,461,043 | B1 | 10/2002 | Healy |
| 6,461,708 | B1 | 10/2002 | Dronzek |
| 6,471,817 | B1 | 10/2002 | Emmert |
| 6,476,743 | B1 | 11/2002 | Brown |
| 6,482,867 | B1 | 11/2002 | Kimura |
| 6,502,986 | B1 | 1/2003 | Bensur |
| 6,517,243 | B2 | 2/2003 | Huffer |
| 6,519,918 | B2 | 2/2003 | Forman et al. |
| 6,538,581 | B2 | 3/2003 | Cowie |
| 6,539,691 | B2 | 4/2003 | Beer |
| 6,554,134 | B1 | 4/2003 | Guibert |
| 6,563,082 | B2 | 5/2003 | Terada |
| 6,589,622 | B1 | 7/2003 | Scott |
| 6,592,260 | B1 | 7/2003 | Randall |
| 6,594,872 | B2 | 7/2003 | Cisek |
| 6,612,432 | B2 | 9/2003 | Motson |
| 6,616,334 | B2 | 9/2003 | Faaborg |
| 6,621,046 | B2 | 9/2003 | Kaji |
| 6,669,046 | B1 | 12/2003 | Sawada |
| 6,691,886 | B1 | 2/2004 | Berndt |
| 6,698,928 | B2 | 3/2004 | Miller |
| 6,726,054 | B2 | 4/2004 | Fagen |
| 6,726,364 | B2 | 4/2004 | Perell |
| 6,746,743 | B2 | 6/2004 | Knoerzer |
| 6,750,423 | B2 | 6/2004 | Tanaka |
| 6,767,604 | B2 | 7/2004 | Muir |
| 6,815,634 | B2 | 11/2004 | Sonoda |
| 6,821,388 | B2 | 11/2004 | Marsh |
| 6,852,947 | B2 | 2/2005 | Tanaka |
| 6,865,860 | B2 | 3/2005 | Arakawa |
| 6,889,483 | B2 | 5/2005 | Compton |
| 6,918,532 | B2 | 7/2005 | Sierra-Gomez |
| 6,929,400 | B2 | 8/2005 | Razeti |
| 6,932,135 | B2 | 8/2005 | Tabuchi |
| 6,945,400 | B2 | 9/2005 | Bolnick |
| 6,951,999 | B2 | 10/2005 | Monforton |
| 6,969,196 | B2 | 11/2005 | Woodham |
| 6,983,875 | B2 | 1/2006 | Emmott |
| 7,007,423 | B2 | 3/2006 | Andersson |
| 7,018,502 | B2 | 3/2006 | Treleaven |
| 7,021,827 | B2 | 4/2006 | Compton |
| 7,032,754 | B2 | 4/2006 | Kopecky |
| 7,032,757 | B2 | 4/2006 | Richards |
| 7,032,810 | B2 | 4/2006 | Benedetti et al. |
| 7,040,810 | B2 | 5/2006 | Steele |
| 7,048,441 | B2 | 5/2006 | Pape |
| 7,051,877 | B2 | 5/2006 | Lin |
| 7,165,888 | B2 | 1/2007 | Rodick |
| 7,172,779 | B2 | 2/2007 | Castellanos |
| 7,207,718 | B2 | 4/2007 | Machacek |
| 7,207,719 | B2 | 4/2007 | Marbler |
| 7,213,710 | B2 | 5/2007 | Cotert |
| 7,228,968 | B1 | 6/2007 | Burgess |
| 7,254,873 | B2 | 8/2007 | Stolmeier |
| 7,261,468 | B2 | 8/2007 | Schneider |
| 7,262,335 | B2 | 8/2007 | Motsch |
| 7,302,783 | B2 | 12/2007 | Cotert |
| 7,344,744 | B2 | 3/2008 | Sierra-Gomez |
| 7,350,688 | B2 | 4/2008 | Sierra-Gomez |
| 7,351,458 | B2 | 4/2008 | Leighton |
| 7,352,591 | B2 | 4/2008 | Sugahara |
| 7,371,008 | B2 | 5/2008 | Bonenfant |
| 7,404,487 | B2 | 7/2008 | Kumakura |
| 7,416,768 | B2 | 8/2008 | Knoerzer |
| 7,422,142 | B2 | 9/2008 | Arippol |
| 7,470,062 | B2 | 12/2008 | Moteki |
| 7,475,781 | B2 | 1/2009 | Kobayashi |
| 7,516,599 | B2 | 4/2009 | Doll |
| 7,527,189 | B2 | 5/2009 | Billig |
| 7,533,733 | B2 | 5/2009 | Nolan |
| 7,533,773 | B2 | 5/2009 | Aldridge |
| 7,600,641 | B2 | 10/2009 | Burgess |
| 7,703,602 | B2 | 4/2010 | Saito |
| 7,708,463 | B2 | 5/2010 | Sampaio Camacho |
| 7,717,620 | B2 | 5/2010 | Hebert |
| 7,740,923 | B2 | 6/2010 | Exner |
| 7,744,517 | B2 | 6/2010 | Bonenfant |
| 7,758,484 | B2 | 7/2010 | Peterson |
| 7,858,901 | B2 | 12/2010 | Krishnan |
| 7,963,413 | B2 | 6/2011 | Sierra-Gomez |
| 2,588,409 | A1 | 7/2011 | Aldridge |
| 7,971,718 | B2 | 7/2011 | Aldridge |
| 8,002,171 | B2 | 8/2011 | Ryan |
| 8,002,941 | B2 | 8/2011 | Exner |
| 8,029,428 | B2 | 10/2011 | Selle |
| 8,038,349 | B2 | 10/2011 | Andersson |
| 8,114,451 | B2 | 2/2012 | Sierra-Gomez |
| 8,181,784 | B2 | 5/2012 | Bouthiette |
| 8,240,546 | B2 | 8/2012 | Friebe |
| 8,262,830 | B2 | 9/2012 | Hebert |
| 8,262,832 | B2 | 9/2012 | Hebert |
| 8,273,434 | B2 | 9/2012 | Zietlow |
| 8,308,363 | B2 | 11/2012 | Vogt |
| 8,408,792 | B2 | 4/2013 | Cole |
| 8,506,165 | B2 | 8/2013 | Shinozaki |
| 8,540,839 | B2 | 9/2013 | Zietlow |
| 8,544,519 | B2 | 10/2013 | Ikeda |
| 8,763,890 | B2 | 7/2014 | Clark |
| 8,920,030 | B2 | 12/2014 | McSweeney |
| 8,951,591 | B2 | 2/2015 | Vogt |
| 8,986,803 | B2 | 3/2015 | Yoshida |

(56) References Cited

U.S. PATENT DOCUMENTS

| | | | |
|---|---|---|---|
| 8,999,100 | B2 | 4/2015 | Carmichael |
| 2001/0000480 | A1 | 4/2001 | Stagg |
| 2002/0000441 | A1 | 1/2002 | Redmond |
| 2002/0068668 | A1 | 6/2002 | Chow |
| 2002/0079247 | A1 | 6/2002 | Wilfong |
| 2002/0182359 | A1 | 12/2002 | Muir |
| 2003/0002753 | A1 | 1/2003 | Stolmeier |
| 2003/0019780 | A1 | 1/2003 | Parodi |
| 2003/0039412 | A1 | 2/2003 | Rodick |
| 2003/0047695 | A1 | 3/2003 | Zik |
| 2003/0051440 | A1 | 3/2003 | Chow |
| 2003/0053720 | A1 | 3/2003 | Smith |
| 2003/0118255 | A1 | 6/2003 | Miller |
| 2003/0127352 | A1 | 7/2003 | Buschkiel |
| 2003/0170357 | A1 | 9/2003 | Garwood |
| 2003/0180486 | A1 | 9/2003 | Pape |
| 2003/0183637 | A1 | 10/2003 | Zappa |
| 2003/0183643 | A1 | 10/2003 | Fagen |
| 2003/0201083 | A1 | 10/2003 | Marsh |
| 2003/0210838 | A1 | 11/2003 | Steele |
| 2003/0217946 | A1 | 11/2003 | Hsu |
| 2003/0223656 | A1 | 12/2003 | Razeti |
| 2004/0011677 | A1 | 1/2004 | Arakawa |
| 2004/0035719 | A1 | 2/2004 | Ebbers |
| 2004/0060974 | A1 | 4/2004 | Dacey |
| 2004/0062838 | A1 | 4/2004 | Castellanos |
| 2004/0067326 | A1 | 4/2004 | Knoerzer |
| 2004/0083680 | A1 | 5/2004 | Compton |
| 2004/0086207 | A1 | 5/2004 | Marbler |
| 2004/0091184 | A1 | 5/2004 | Miller |
| 2004/0112010 | A1 | 6/2004 | Richards |
| 2004/0112771 | A1 | 6/2004 | Bailey |
| 2004/0150221 | A1 | 8/2004 | Brown |
| 2004/0175060 | A1 | 9/2004 | Woodham |
| 2004/0180118 | A1 | 9/2004 | Renger |
| 2004/0206637 | A1 | 10/2004 | Sierra-Gomez |
| 2005/0000965 | A1 | 1/2005 | Boardman |
| 2005/0031233 | A1 | 2/2005 | Varanese |
| 2005/0084186 | A1 | 4/2005 | Caris |
| 2005/0084188 | A1 | 4/2005 | Liao |
| 2005/0116016 | A1 | 6/2005 | LoDuca |
| 2005/0117819 | A1 | 6/2005 | Kingsford |
| 2005/0186368 | A1 | 8/2005 | Leighton |
| 2005/0220371 | A1 | 10/2005 | Machacek |
| 2005/0247764 | A1 | 11/2005 | Sierra-Gomez |
| 2005/0276525 | A1 | 12/2005 | Hebert |
| 2005/0276885 | A1 | 12/2005 | Bennett |
| 2005/0284776 | A1 | 12/2005 | Kobayashi |
| 2006/0000738 | A1 | 1/2006 | Kumakura |
| 2006/0018569 | A1 | 1/2006 | Bonenfant |
| 2006/0066096 | A1 | 3/2006 | Kan |
| 2006/0083446 | A1 | 4/2006 | SampaioCamacho |
| 2006/0124494 | A1 | 6/2006 | Clark |
| 2006/0144911 | A1 | 7/2006 | Sierra-Gomez |
| 2006/0147129 | A1 | 7/2006 | Miller |
| 2006/0171611 | A1 | 8/2006 | Rapparini |
| 2006/0199717 | A1 | 9/2006 | Marbler |
| 2006/0251342 | A1 | 11/2006 | Forman |
| 2006/0257056 | A1 | 11/2006 | Miyake |
| 2006/0257599 | A1 | 11/2006 | Exner |
| 2006/0261050 | A1 | 11/2006 | Krishnan |
| 2006/0283750 | A1 | 12/2006 | Villars |
| 2006/0285779 | A1 | 12/2006 | Golas |
| 2007/0023435 | A1 | 2/2007 | Sierra-Gomez |
| 2007/0023436 | A1 | 2/2007 | Sierra-Gomez |
| 2007/0095709 | A1 | 5/2007 | Saito |
| 2007/0116388 | A1 | 5/2007 | Kuge |
| 2007/0140600 | A1 | 6/2007 | Nowak |
| 2007/0209959 | A1 | 9/2007 | Burgess |
| 2007/0269142 | A1 | 11/2007 | Tyska |
| 2007/0275133 | A1 | 11/2007 | Sierra-Gomez |
| 2008/0013869 | A1 | 1/2008 | Forman |
| 2008/0031555 | A1 | 2/2008 | Roberts |
| 2008/0034713 | A1 | 2/2008 | Kohl |
| 2008/0037911 | A1 | 2/2008 | Cole |
| 2008/0041750 | A1 | 2/2008 | Kohlweyer |
| 2008/0053861 | A1 | 3/2008 | Mellin |
| 2008/0060751 | A1 | 3/2008 | Arrindell |
| 2008/0063324 | A1 | 3/2008 | Bernard |
| 2008/0063759 | A1 | 3/2008 | Raymond |
| 2008/0063760 | A1 | 3/2008 | Raymond |
| 2008/0101733 | A1 | 5/2008 | Fenn-Barrabass |
| 2008/0131035 | A1 | 6/2008 | Rogers |
| 2008/0135428 | A1 | 6/2008 | Tallier |
| 2008/0152264 | A1 | 6/2008 | Pokusa |
| 2008/0156861 | A1 | 7/2008 | Sierra-Gomez |
| 2008/0159666 | A1 | 7/2008 | Exner |
| 2008/0199109 | A1 | 8/2008 | Rutzinger |
| 2008/0203141 | A1 | 8/2008 | Friebe |
| 2008/0214376 | A1 | 9/2008 | Bonenfant |
| 2008/0220227 | A1 | 9/2008 | Keeney |
| 2008/0240627 | A1 | 10/2008 | Cole |
| 2008/0273821 | A1 | 11/2008 | Doll |
| 2008/0292225 | A1 | 11/2008 | Dayrit |
| 2009/0001143 | A1 | 1/2009 | Cowan |
| 2009/0014491 | A1 | 1/2009 | Fuisz |
| 2009/0022431 | A1 | 1/2009 | Conner |
| 2009/0028472 | A1 | 1/2009 | Andersson |
| 2009/0053372 | A1 | 2/2009 | Hambrick |
| 2009/0074333 | A1 | 3/2009 | Griebel |
| 2009/0097786 | A1 | 4/2009 | Goglio |
| 2009/0161995 | A1 | 6/2009 | Henderson |
| 2009/0190866 | A1 | 7/2009 | Hughes |
| 2009/0211938 | A1 | 8/2009 | Aldridge |
| 2009/0226117 | A1 | 9/2009 | Davis |
| 2009/0232425 | A1 | 9/2009 | Tai |
| 2009/0273179 | A1 | 11/2009 | Scott |
| 2009/0301903 | A1 | 12/2009 | Andersson |
| 2010/0002963 | A1 | 1/2010 | Holbert |
| 2010/0018974 | A1 | 1/2010 | Lyzenga |
| 2010/0019022 | A1 | 1/2010 | Ryan |
| 2010/0111453 | A1 | 5/2010 | Dierl |
| 2010/0113241 | A1 | 5/2010 | Hebert |
| 2010/0147724 | A1 | 6/2010 | Mitra-Shah |
| 2010/0172604 | A1 | 7/2010 | Andersson |
| 2010/0226598 | A1 | 9/2010 | Stoeppelmann |
| 2010/0230303 | A1 | 9/2010 | Buse |
| 2010/0230411 | A9 | 9/2010 | Sierra-Gomez |
| 2010/0278454 | A1 | 11/2010 | Huffer |
| 2010/0303391 | A9 | 12/2010 | Cole |
| 2011/0035399 | A1 | 2/2011 | Deng |
| 2011/0049158 | A1 | 3/2011 | Bouthiette |
| 2011/0058755 | A1 | 3/2011 | Guibert |
| 2011/0127319 | A1 | 6/2011 | Golden |
| 2011/0132976 | A1 | 6/2011 | Drewnowski |
| 2011/0147443 | A1 | 6/2011 | Igo |
| 2011/0204056 | A1 | 8/2011 | Veternik et al. |
| 2011/0253718 | A1 | 10/2011 | Sierra-Gomez |
| 2012/0125932 | A1 | 5/2012 | Sierra-Gomez |
| 2012/0128835 | A1 | 5/2012 | Lyzenga |
| 2012/0177307 | A1 | 7/2012 | Duan |
| 2013/0004626 | A1 | 1/2013 | Renders et al. |
| 2013/0011527 | A1 | 1/2013 | Renders |
| 2013/0064477 | A1 | 3/2013 | Vogt |
| 2013/0064934 | A1 | 3/2013 | Vogt |
| 2013/0114918 | A1 | 5/2013 | Lyzenga |
| 2013/0121623 | A1 | 5/2013 | Lyzenga |
| 2013/0121624 | A1 | 5/2013 | Lyzenga |
| 2013/0205964 | A1 | 8/2013 | Matsushita |
| 2013/0270268 | A1 | 10/2013 | Lyzenga |
| 2014/0185965 | A1 | 7/2014 | Lyzenga |
| 2014/0270597 | A1 | 9/2014 | Friedman |
| 2014/0314339 | A1 | 10/2014 | Docherty |
| 2015/0016756 | A1 | 1/2015 | Down |
| 2015/0021219 | A1 | 1/2015 | SeyfferthDeOliveira |

FOREIGN PATENT DOCUMENTS

| | | |
|---|---|---|
| AU | 2004295316 | 6/2005 |
| AU | 2005254459 | 12/2005 |
| AU | 2006337982 | 8/2007 |
| AU | 2007309154 | 5/2008 |
| AU | 2008223524 | 9/2008 |
| AU | 2008229190 | 9/2008 |

(56) References Cited

FOREIGN PATENT DOCUMENTS

| | | | |
|---|---|---|---|
| BR | 55008852 | | 11/2001 |
| BR | 62020307 | | 4/2003 |
| BR | 68046367 | | 10/2009 |
| CN | 1224396 | A | 7/1999 |
| CN | 1781819 | A | 6/2006 |
| DE | 1848870 | | 3/1962 |
| DE | 3700988 | A1 | 7/1988 |
| DE | 3835721 | A1 | 5/1990 |
| DE | 9003401 | | 5/1990 |
| DE | 9005297 | | 8/1990 |
| DE | G90140656 | | 4/1991 |
| DE | 4134567 | | 1/1993 |
| DE | 4241423 | | 6/1994 |
| DE | 19738411 | | 3/1999 |
| DE | 19822328 | A1 | 11/1999 |
| DE | 202004012301 | | 12/2004 |
| DE | 20122333 | | 3/2005 |
| DE | 202007005487 | | 6/2007 |
| DE | 102007030267 | A1 | 1/2009 |
| DE | 202009000302 | | 3/2009 |
| DE | 102010019867 | A1 | 9/2011 |
| EP | 0085289 | | 8/1983 |
| EP | 0298054 | A2 | 1/1989 |
| EP | 0307924 | A2 | 3/1989 |
| EP | 0388310 | | 9/1990 |
| EP | 0396967 | A2 | 11/1990 |
| EP | 408831 | A1 | 1/1991 |
| EP | 0474981 | A1 | 6/1991 |
| EP | 0447636 | | 9/1991 |
| EP | 0488967 | | 6/1992 |
| EP | 0546369 | | 6/1993 |
| EP | 0608909 | | 8/1994 |
| EP | 0613824 | | 9/1994 |
| EP | 0629561 | A2 | 12/1994 |
| EP | 0661154 | | 7/1995 |
| EP | 0667828 | | 8/1995 |
| EP | 0669204 | B2 | 8/1995 |
| EP | 0744357 | | 11/1996 |
| EP | 0752375 | | 1/1997 |
| EP | 0758993 | | 2/1997 |
| EP | 0796206 | | 9/1997 |
| EP | 0796208 | | 9/1997 |
| EP | 0905048 | A | 3/1999 |
| EP | 1046594 | | 10/2000 |
| EP | 1056066 | | 11/2000 |
| EP | 1086906 | A2 | 3/2001 |
| EP | 1136379 | | 9/2001 |
| EP | 1288139 | | 3/2003 |
| EP | 1318081 | A1 | 6/2003 |
| EP | 1350741 | | 10/2003 |
| EP | 1375380 | A1 | 1/2004 |
| EP | 1382543 | A2 | 1/2004 |
| EP | 1437311 | A1 | 7/2004 |
| EP | 1449789 | A1 | 8/2004 |
| EP | 1457424 | | 9/2004 |
| EP | 1467929 | | 10/2004 |
| EP | 1468936 | | 10/2004 |
| EP | 1477425 | A1 | 11/2004 |
| EP | 1488936 | | 12/2004 |
| EP | 1608567 | | 12/2005 |
| EP | 1609737 | | 12/2005 |
| EP | 1619137 | A1 | 1/2006 |
| EP | 1637472 | A1 | 3/2006 |
| EP | 1697230 | | 9/2006 |
| EP | 1351861 | | 10/2006 |
| EP | 1712468 | | 10/2006 |
| EP | 1712488 | A1 | 10/2006 |
| EP | 1755980 | | 2/2007 |
| EP | 1760006 | A1 | 3/2007 |
| EP | 1770025 | | 4/2007 |
| EP | 1846306 | | 10/2007 |
| EP | 1858776 | | 11/2007 |
| EP | 1873082 | A1 | 1/2008 |
| EP | 1908696 | | 4/2008 |
| EP | 1939107 | | 7/2008 |
| EP | 1975081 | A1 | 10/2008 |
| EP | 2033910 | | 3/2009 |
| EP | 2189506 | | 5/2010 |
| FR | 1327914 | A | 5/1963 |
| FR | 2674509 | | 10/1992 |
| FR | 2693988 | | 1/1994 |
| FR | 2766794 | | 2/1999 |
| FR | 2772009 | | 6/1999 |
| FR | 2783512 | | 3/2000 |
| GB | 1107200 | | 3/1968 |
| GB | 2171077 | | 8/1986 |
| GB | 2266513 | | 11/1993 |
| GB | 2276095 | A | 9/1994 |
| GB | 2335652 | A | 9/1999 |
| GB | 2339187 | A | 1/2000 |
| JP | 57163658 | | 10/1982 |
| JP | S5822411 | B2 | 5/1983 |
| JP | 6080405 | | 5/1985 |
| JP | 62171479 | | 10/1987 |
| JP | 63022370 | | 1/1988 |
| JP | 01167084 | A | 6/1989 |
| JP | 01226579 | A | 9/1989 |
| JP | 01267182 | A | 10/1989 |
| JP | H11343468 | | 12/1990 |
| JP | H0581083 | | 11/1993 |
| JP | 09142551 | A | 6/1997 |
| JP | 09150872 | | 6/1997 |
| JP | H09156677 | A | 6/1997 |
| JP | 10059441 | | 3/1998 |
| JP | 10120016 | A1 | 5/1998 |
| JP | 10129685 | | 5/1998 |
| JP | H10167355 | | 6/1998 |
| JP | 10152179 | A | 9/1998 |
| JP | H10509406 | | 9/1998 |
| JP | H0444968 | | 2/1999 |
| JP | 11198977 | | 7/1999 |
| JP | 2000335542 | A | 12/2000 |
| JP | 2001114357 | | 4/2001 |
| JP | 2001301807 | | 10/2001 |
| JP | 2002002805 | A | 1/2002 |
| JP | 2002104550 | A | 4/2002 |
| JP | 200326224 | | 1/2003 |
| JP | 2003026224 | A | 1/2003 |
| JP | 2003072774 | | 3/2003 |
| JP | 2003137314 | | 5/2003 |
| JP | 2005015015 | | 1/2005 |
| JP | 200602767 | | 2/2006 |
| JP | 2006062712 | | 3/2006 |
| JP | 2006137445 | A | 6/2006 |
| JP | 2006199343 | | 8/2006 |
| JP | 2007045434 | | 2/2007 |
| JP | 2008105751 | | 5/2008 |
| JP | 2009166870 | | 7/2009 |
| NZ | 555274 | | 12/2008 |
| WO | 8606350 | | 11/1986 |
| WO | 9104920 | | 4/1991 |
| WO | 9411270 | | 5/1994 |
| WO | 9411270 | A1 | 5/1994 |
| WO | 9424019 | A2 | 10/1994 |
| WO | 9532902 | A1 | 12/1995 |
| WO | 9725200 | | 7/1997 |
| WO | 0061458 | A | 10/2000 |
| WO | 0064755 | | 11/2000 |
| WO | 0140073 | A1 | 6/2001 |
| WO | 02064365 | A1 | 8/2002 |
| WO | 02066341 | | 8/2002 |
| WO | 03013976 | A1 | 2/2003 |
| WO | 03035504 | | 5/2003 |
| WO | 03037727 | | 5/2003 |
| WO | 03059776 | A1 | 7/2003 |
| WO | 2004087527 | A1 | 10/2004 |
| WO | 2005054079 | | 6/2005 |
| WO | 2005056420 | | 6/2005 |
| WO | 2005110042 | | 11/2005 |
| WO | 2005110865 | | 11/2005 |
| WO | 2005110876 | | 11/2005 |
| WO | 2005110885 | A2 | 11/2005 |
| WO | 2005120989 | | 12/2005 |
| WO | 2005123535 | A1 | 12/2005 |

(56) References Cited

FOREIGN PATENT DOCUMENTS

| | | | |
|---|---|---|---|
| WO | 2006055128 | A2 | 5/2006 |
| WO | 2006080405 | | 8/2006 |
| WO | 2006108614 | | 10/2006 |
| WO | 2007079071 | A1 | 7/2007 |
| WO | 2007090419 | | 8/2007 |
| WO | 2008051813 | | 5/2008 |
| WO | 2008062159 | A1 | 5/2008 |
| WO | 2008074060 | | 6/2008 |
| WO | 2008108969 | | 9/2008 |
| WO | 2008115693 | A1 | 9/2008 |
| WO | 2008122961 | | 10/2008 |
| WO | 2008146142 | | 12/2008 |
| WO | 2009065120 | | 5/2009 |
| WO | 2009111153 | | 9/2009 |
| WO | 2010002834 | | 1/2010 |
| WO | 2010046623 | | 4/2010 |
| WO | 2010051146 | A2 | 5/2010 |
| WO | 2010080810 | | 7/2010 |
| WO | 2010084336 | A1 | 7/2010 |
| WO | 2010088492 | A1 | 8/2010 |
| WO | 2010114879 | A1 | 10/2010 |
| WO | 2010149996 | A1 | 12/2010 |
| WO | 2011004156 | A2 | 1/2011 |
| WO | 2011032064 | | 3/2011 |
| WO | 2011121337 | A2 | 10/2011 |
| WO | 2011123410 | | 10/2011 |
| WO | 2011146616 | | 11/2011 |
| WO | 2011146627 | | 11/2011 |
| WO | 2011146658 | | 11/2011 |
| WO | 2012036765 | | 3/2012 |
| WO | 2012098412 | | 7/2012 |

OTHER PUBLICATIONS

U.S. District Court for the Northern District of Illinois, Eastern Division, Memorandum Opinion and Order, dated Aug. 3, 2015, 37 pages.
English Translation of JP2002-002805 filed by Onuma, published Sep. 1, 2012, translation provided by the USPTO in U.S. Appl. No. 11/193,614.
English Translation of JP2003-026224 published Jan. 29, 2003, translated on Jul. 27, 2015. Translation provided by USPTO in U.S. Appl. No. 14/175,434, 9 pages.
English Translation of JP2001-301807 published Oct. 31, 2001, translated on Jul. 27, 2015. Translation provided by USPTO in U.S. Appl. No. 14/175,434, 6 pages.
'Cheese Range', Mintel gnpd, Jan. 26, 2001, Mintel Publishing, 1 page.
'Elite Edam Cheese', Mintel gnpd, Dec. 3, 2001, Mintel Publishing, 2 pages.
'Margin.' Merriam-Webster Online Dictionary. 2010. Merriam-Webster [online], retrieved on May 6, 2010, Retrieved from the internet:URL: http://www.merriam-webster.com/dictionary/margin, 3 pages.
'New Easy Peel Cheese Packaging', Mintel gnpd, Aug. 10, 2001, Mintel Publishing.
'New on the Shelf-Product Instructions and Packaging Trends', Circle Reader Service Card No. 93, Aug. 1998, Baking & Snack.
'Soft Bread Sticks', Mintel gnpd, Mar. 20, 1998, Mintel Publishing, 1 page.
"Wall's Bacon A Sizzling Success Story" and The Grocer: "When sealed delivers", the second page of which bears a date of Aug. 21, 1999.
40 Packaging News PPMA Preview Sep. 2001.
Defendants' Answer, Affirmative Defenses, and Counterclaims Responsive to Complaint, dated Apr. 5, 2012, 25 pages.
Defendants' Final Invalidity Contentions—Exhibit A-1, dated Sep. 27, 2013, 55 pages.
Defendants' Final Invalidity Contentions—Exhibit A-2, dated Sep. 27, 2013, 35 pages.
Defendants' Final Invalidity Contentions—Exhibit A-3, dated Sep. 27, 2013, 34 pages.
Defendants' Final Invalidity Contentions—Exhibit A-4, dated Sep. 27, 2013, 35 pages.
Defendants' Final Invalidity Contentions—Exhibit B-1, dated Sep. 27, 2013, 135 pages.
Defendants' Final Invalidity Contentions—Exhibit B-2, dated Sep. 27, 2013, 64 pages.
Defendants' Final Invalidity Contentions—Exhibit B-3, dated Sep. 27, 2013, 140 pages.
Defendants' Final Invalidity Contentions—Exhibit B-4, dated Sep. 27, 2013, 273 pages.
Defendants' Final Invalidity Contentions—Exhibit B-5, dated Sep. 27, 2013, 146 pages.
Defendants' Final Invalidity Contentions—Exhibit B-6, dated Sep. 27, 2013, 226 pages.
Defendants' Final Invalidity Contentions Pursuant to LPR 3.1, dated Sep. 27, 2013, 22 pages.
Defendants' Final Unenforceability Contentions Pursuant to LPR 3.1, dated Sep. 27, 2013, 14 pages.
Defendants' Initial Non-Infringement Contentions Pursuant to LPR 2.3(a), dated May 17, 2013, 7 pages.
Defendants' Invalidity Contentions—Exhibit A-1, dated May 17, 2013, 55 pages.
Defendants' Invalidity Contentions—Exhibit A-2, dated May 17, 2013, 35 pages.
Defendants' Invalidity Contentions—Exhibit A-3, dated May 17, 2013, 34 pages.
Defendants' Invalidity Contentions—Exhibit A-4, dated May 17, 2013, 35 pages.
Defendants' Invalidity Contentions—Exhibit A-5, dated May 17, 2013, 39 pages.
Defendants' Invalidity Contentions Pursuant to LPR 2.3, dated May 17, 2013, 23 pages.
Defendants' LPR 2.3 Initial Non-Infringement Contentions Exhibit A, dated May 17, 2013, 39 pages.
Defendants' Unenforceability Contentions Pursuant to LPR 2.3, dated May 17, 2013, 13 pages.
English Translation of JP H09-156677 published on Jun. 17, 1997, 2 pages.
Machine translation of claim for BR 5500885-2 from Googletranslate.com; 1 page, Oct. 2012.
Machine translation of claim for BR 6202030-7 from Googletranslate.com; 1 page, Oct. 2012.
Machine translation of claim for BR 6804636-7 from Googletranslate.com; 1 page, Oct. 2012.
English Translation of Japanese Official Notice of Rejection mailed on Feb. 14, 2012 in JP Application No. 2009-172352, citing Japanese Laid Open Application No. 62-171479, 3 pages.
English Translation of JP 1998-152179 (H10-152179 A), published on Sep. 6, 1998, 6 pages.
English Translation of JP 2001-114357 published on Apr. 24, 2001, 8 pages.
English Translation of JP 2003-26224 published on Jan. 29, 2003, 13 pages.
English Translation of JP Official Notice of Rejection mailed on Jan. 29, 2013 in JP Appl. No. 2008-087152, 5 pages.
European Packaging Pack Report, NR. 5 Mai 2001 and partial translation thereof, 6 pages.
European Search Report, EP10305289, 3 pages, Jan. 2011.
European Search Report 06118142.6 dated May 3, 2007, 10 pages.
Fuji Packaging GmbH Fachpack brochure, Oct. 11-12, 2001; 2 pages.
Giant Baby Wipes package, item No. 80203-91, resealable package having die cut-out portions (tabs) which remain affixed to the top of the package after label is withdrawn from the top, whereby tamper evidence is indicated by a misalignment of the die cut-out portions with the holes formed in the label.
Global Brands' LPR 2.5 Initial Response to Defendants' Initial Invalidity Contentions Chart Ex. A-1, dated May 31, 2013, 30 pages.

(56) References Cited

OTHER PUBLICATIONS

Global Brands' LPR 2.5 Initial Response to Defendants' Initial Invalidity Contentions Chart Ex. A-2, dated May 31, 2013, 20 pages.
Global Brands' LPR 2.5 Initial Response to Defendants' Initial Invalidity Contentions Chart Ex. A-3, dated May 31, 2013, 21 pages.
Global Brands' LPR 2.5 Initial Response to Defendants' Initial Invalidity Contentions Chart Ex. A-5, dated May 31, 2013, 14 pages.
Global Brands LPR 2.5 Initial Response to Defendants' Initial Invalidity Contentions Chart Ex. A-4, dated May 31, 2013, 17 pages.
International Search Report, PCT/EP2011/054250 dated Jun. 28, 2011, 3 pages.
Machine translation of DE 202007005487, published Jun. 14, 2007, provided by Espacenet, 3 pages.
Machine translation of DE 202009000302, published Mar. 19, 2009, provided by Espacenet, 9 pages.
Machine translation of DE9014065, published Mar. 19, 2009, provided by Espacenet, 9 pages.
Machinery Update, Mar./Apr. 2002, pp. 56-62.
Machinery Update, Mar./Apr. 2002, pp. 59-60.
Machinery Update, Sep./Oct. 2001, pp. 46-47.
Opposition to EP1679269 filed by Awapatent AB, Helsingborg, Sweden. May 2, 2012.
Opposition to EP1679269 filed by Bahlse GmbH and Co. KG, Apr. 30, 2012.
Partial European Search Report for Appl. No. EP11155570 dated Jun. 12, 2011, 9 pages.
Patent Abstracts of Japan, vol. 1997 No. 10, Oct. 31, 1997 and JP09156677 A (Fuji Seal Co. Ltd.) (Jun. 17, 1997) abstract in English and 7 figures.
Plaintiff's Initial Response to Defendant's Initial Invalidity Contentions, dated May 31, 2013, 20 pages.
Plaintiffs Answer to Counterclaims of Defendant, dated Apr. 26, 2013, 20 pages.
Plaintiffs Complaint for Patent Infringement, dated Jan. 16, 2013, 7 pages.
Reclosure system lengthens food life, Packaging News PPMA Preview, Sep. 2001, 4 pages.
Reseal-It. Web page Internet print out accessed Mar. 14, 2005; 19 pages.
Defendants' Supplemental Memorandum of Law Regarding Additional Claim Construction Authority Requested by the Court, dated Feb. 28, 2014, 13 pages.
English Translation of Japanese Unexamined Application Publication No. H9-156677, published Jul. 17, 1997; 6 pages.
Kellogg's Opening Claim Construction Brief, dated Dec. 13, 2013, 30 pages.
Kellogg's Reply Claim Construction Brief, dated Jan. 24, 2014, 19 pages.
Kellogg's Response to Plaintiff's Surreply Claim Construction Brief Pursuant to Docket No. 98, dated Feb. 28, 2014, 9 pages.
Machine translation of CN 1781819A published Jun. 7, 2006 from google.com/patents; 13 pages, accessed Jun. 5, 2014.
Plaintiff Intercontinental Great Brands LLC's Responsive Claim Construction Brief Pursuant to LPR 4.2, dated Feb. 10, 2014, 27 pages.
Plaintiff Intercontinental Great Brands LLC's Submission of Authority Pursuant to Docket No. 98, dated Feb. 28, 2014, 11 pages.
Plaintiff Intercontinental Great Brands LLC's Surreply Claim Construction Brief Pursuant to Docket No. 98, dated Feb. 21, 2014, 6 pages.
U.S. District Court for the Northern District of Illinois, Eastern Division Memorandum Opinion and Order, dated Sep. 22, 2014, 12 pages.
Additional Exhibits from Declaration of James Lukas Jr. filed Mar. 26, 2015, 73 pages.
Declaration of James J. Lukas, Jr. in Support of Defendants' Motion for Summary Judgment with Exhibits, Part 1 dated Mar. 23, 2015, 277 pages.
Declaration of James J. Lukas, Jr. in Support of Defendants' Opposition to Plaintiff's Motions for Summary Judgment with Exhibits (redacted), dated May 28, 2015, 228 pages.
Declaration of Katie Crosby Lehmann in Support of Plaintiff's Consolidated Memorandum of Law in Support of Plaintiff's Cross-Motion for Summary Judgment with Exhibits Part 1 (redacted), dated May 8, 2015, 400 pages.
Declaration of Katie Crosby Lehmann in Support of Plaintiff's Reply in Support of its Motions for Summary Judgment and Exhibit (unsealed), dated Jun. 10, 2015, 8 pages.
Defendants' Consolidated Memorandum in Support of Motion for Summary Judgment (redacted) with Exhibits A-G, dated Mar. 23, 2015, 166 pages.
Defendants' Consolidated Reply in Support of Defendants' Motion for Summary Judgment with Exhibits, dated May 28, 2015, 36 pages.
Defendants' Local Rule 56.1 Statement of Material Facts in Support of Motion for Summary Judgment (redacted), dated Mar. 23, 2015, 75 pages.
Defendants' LR 56.1 (b) (3) (C) Statement of Additional Material Facts in Support of Their Opposition to Plaintiff's Motions for Summary Judgment (redacted), dated May 28, 2015, 30 pages.
Defendants' Memorandum in Support of Motion for Summary Judgment of Non-Infringement and Their Motion for Summary Judgment of Invalidity Under 35 U.S.C. 102 and/or 103, dated Mar. 26, 2015, 60 pages.
Defendants' Memorandum in Support of Their Motion to Compel Discovery, dated Oct. 13, 2014, 13 pages.
Defendants' Motion for Summary Judgment of Non-Infringement and Motion for Summary Judgment of Invalidity Under 35 U.S.C. 102 and/or 103, dated Mar. 23, 2015, 4 pages.
Defendants' Motion to Compel Discovery, dated Oct. 13, 2014, 3 pages.
Defendants' Response to Plaintiff's Local Rule 56.1 Statement of Material Facts in Support of Plaintiff's Motions for Summary Judgment, dated May 28, 2015, 108 pages.
Exhibits, part 2, to Declaration of James J. Lukas, Jr. in Support of Defendants' Motion for Summary Judgment, dated Mar. 23, 2015 125 pages.
Exhibits, part 2, to Declaration of Katie Crosby Lehmann in Support of Plaintiff's Consolidated Memorandum of Law in Support of Plaintiff's Cross-Motion for Summary Judgment (redacted), dated May 8, 2015, 300 pages.
Exhibits, part 3, to Declaration of James J. Lukas, Jr. in Support of Defendants' Motion for Summary Judgment, dated Mar. 23, 2015, 125 pages.
Exhibits, part 3, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 4, to Declaration of James J. Lukas, Jr. in Support of Defendants' Motion for Summary Judgment with Exhibits, dated Mar. 23, 2015, 28 pages.
Exhibits, part 4, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 5, to Declaration of Katie Crosby Lehmann in Support of Plaintiff's Consolidated Memorandum of Law in Support of Plaintiff's Cross-Motion for Summary Judgment (redacted), dated May 8, 2015, 200 pages.
Exhibits, part 6, to Declaration of Katie Crosby Lehmann in Support of Plaintiff's Consolidated Memorandum of Law in Support of Plaintiff's Cross-Motion for Summary Judgment (redacted),dated May 8, 2015, 300 pages.
Exhibits, part 7, to Declaration of Katie Crosby Lehmann in Support of Plaintiff's Consolidated Memorandum of Law in Support of Plaintiff's Cross-Motion for Summary Judgment (redacted),dated May 8, 2015, 136 pages.

(56) References Cited

OTHER PUBLICATIONS

Exhibits from Defendants' Memorandum in Support of Their Motion to Compel Discovery, dated Oct. 13, 2014, 68 pages.
Exhibits from Plaintiff's Memorandum of Law in Opposition to Defendants' Motion to Compel Discovery, Oct. 15, 2014, 78 pages.
Plaintiff's Consolidated Memorandum of Law in Support of Plaintiff's Cross-Motion for Summary Judgment, dated May 8, 2015, 54 pages.
Plaintiff's Cross-Motion for Summary Judgment, dated Apr. 27, 2015, 4 pages.
Plaintiff's LR 56.1(a) Response to Defendants' Statement of Additional Material Facts in Support of Their Opposition to Plaintiff's Motion for Summary Judgment (redacted), dated Jun. 10, 2015, 39 pages.
Plaintiff's Memorandum of Law in Opposition to Defendants' Motion to Compel Discovery, Oct. 15, 2014, 12 pages.
Plaintiff's Reply in Support of its Motions for Summary Judgment, dated Jun. 1, 2015, 19 pages.
Machine Translation of EP 1449789 description. Translated on Jun. 13, 2015, 18 pages.
Defendant's Local Rule 56.1 Statement of Material Facts in Support of Motion for Summary Judgment, dated Mar. 23, 2015, 75 pages.
Definition of "end." Webster's New World Dictionary, Third College Edition. 1988 Simon & Schuster, cited by USPTO in U.S. Appl. No. 11/193,614, dated Jan. 21, 2016, 3 pages.
Machine Translation of the description of DE 3835721. Translation provided by USPTO in U.S. Appl. No. 14/005,783, dated Jan. 21, 2016, 17 pages.
Non-Confidential Brief for Plaintiff-Appellant Intercontinental Great Brands LLC, dated Dec. 30, 2015, 149 pages, filed with the Federal Circuit in Case Nos. 2015-2082, -2084 (litigation related to U.S. Pat. No. 6,918,532).
European Extended Search Report for Application No. 16180214.5, dated Sep. 26, 2016, 7 pages.
Brief of Defendants-Cross-Appellants; dated Jun. 17, 2016; 86 pages, filed with the Federal Circuit in Case Nos. 2015-2082, -2084.
Non-Confidential Responsive/Reply Brief for Plaintiff-Appellant Intercontinental Great Brands LLC, dated Sep. 30, 2016; 69 pages, filed with the Federal Circuit in Case Nos. 2015-2082, -2084.
Reply Brief of Defendants-Cross-Appellants; dated Oct. 14, 2016, 37 pages, filed with the Federal Circuit in Case Nos. 2015-2082, -2084.

PACKAGE INTEGRITY INDICATOR FOR CONTAINER CLOSURE

CROSS-REFERENCE TO RELATED APPLICATIONS

This application is a continuation of U.S. patent application Ser. No. 14/244,399, filed Apr. 3, 2014, which is now issued as U.S. Pat. No. 8,951,591, which is a continuation of U.S. patent application Ser. No. 13/668,425, filed Nov. 5, 2012, which is now issued as U.S. Pat. No. 8,722,122, which is a divisional of U.S. patent application Ser. No. 11/500,497, filed Aug. 8, 2006, which is now issued as U.S. Pat. No. 8,308,363, which is a continuation-in-part of U.S. patent application Ser. No. 11/438,705, filed May 23, 2006, which is now issued as U.S. Pat. No. 7,963,413, and this application also is a continuation-in-part of U.S. patent application Ser. No. 13/108,582, filed on May 16, 2011, which is now issued as U.S. Pat. No. 8,746,483, which is a divisional of U.S. patent application Ser. No. 11/438,705, filed May 23, 2006, which is now issued as U.S. Pat. No. 7,963,413, which are incorporated herein by reference in their entirety.

FIELD OF THE INVENTION

The present invention relates to a resealable closure for packages storing articles and, more particularly, resealable closures for packages having a package integrity indicator.

BACKGROUND OF THE INVENTION

Some containers for food products, such as cookies and other snacks, typically include an outer wrapper. In one type of container, the wrapper surrounds a frame which acts as a tray to hold the food product and to protect the food product from damage. Other food products come packaged in plastic trays, such as thermoform trays which are sealed on the top using some type of lidding material. One recent advancement in the art of food container closures includes a resealable closure disclosed in U.S. Pat. No. 6,918,532 (hereinafter the "'532 patent"), herein incorporated by reference, which discloses a wrapper which forms a top of the container which has an access opening covered by a resealable sealing panel.

In the packaging art, different methods have been used to indicate whether a package has been previously opened or whether the integrity of the package has been compromised, often referred to in the art as "tamper-evident." For example, U.S. Patent Application Publication No. 2005/0247764, herein incorporated by reference, discloses means for indicating package integrity using die-cut elongated strips running adjacent to the opening in a sealing area which is defined as the area around the opening of the container, under the sealing panel, and U.S. patent application Ser. No. 11/438,705, herein incorporated by reference, discloses a package integrity indicator in the form of at least one flap or elongated strip which terminates at an opening covered by a closure, where the flap or elongated strip falls into a container sealed with the closure after the container has been opened for the first time.

There is a need for improvements in the art for package integrity indicators for a resealable closure, preferably suitable for use with a resealable closure for containers or packages containing food items.

SUMMARY OF THE INVENTION

The present invention generally relates to a resealable closure for a container formed from a two-ply material which has a package integrity indicator in the form of a panel or flap which terminates at an opening covered by the closure, wherein the panel or flap falls into the container after the container has been opened for a first time.

The present invention, in one form, comprises a package integrity indicating closure comprising an at least two-ply material comprising a first film layer adhesively joined to a second film layer. A first tear line formed into the first film layer, defines a first panel for providing an access opening through the first film layer when separated from the first film layer along the first tear line, and a second tear line formed into the first layer and terminating at the first tear line to thereby define a second panel for indicating an initial opening of the closure when the second panel is separated from the first panel along the first layer tear line. The second film layer has a second layer tear line defining a sealing panel which completely covers the first panel and the second panel of the first film layer. A releasable adhesive releasably adheres the sealing panel to the first film layer such that the sealing panel is separated from the first film layer and the second panel to expose the access opening and to provide a visual indication that the closure has been opened after the sealing panel has been peeled back from the first film layer for a first time.

The second film layer may comprise a see through window portion lying over the second panel of the first layer such that the second panel is visible therethrough prior to the closure being opened for a first time.

The integrity indicating closure for a container may comprise a two-ply material forming a top of the container in which the top is formed to provide an access opening into the container and a flap located adjacent the access opening. A sealing panel of the outer layer is adhesively sealed to the top around the opening such that the flap is visible through a window portion of the sealing panel. The sealing panel is resealably sealed to the inner layer around the opening and the sealing panel is releasable from the top and is separable from the flap by pulling the sealing panel back in a peeling direction and reclosable against the top to seal the opening when the sealing panel is moved back against the top, whereby, after closing, the flap is separated from the sealing panel, and thereby observable through the window portion as not being attached to the sealing panel.

In alternative further embodiments, the flap is integrally formed with the inner layer and the flap is spaced from opposed sides of the opening. The outer layer may be composed of a material allowing visual perception of the flap of the inner layer.

The present invention, in another form thereof, concerns an integrity indicating food container comprising a tray and an at least two-ply material comprising an inner layer adhesively joined to an outer layer to form a top over the tray. The top is formed to provide an access opening for access to food items disclosed in the tray. The inner layer has a first panel and a second panel. The outer layer has a sealing panel formed therein which completely covers the first panel and covers the second panel of the inner layer. The first panel and the sealing panel are permanently joined to each other to form the access opening into the container. A releasable adhesive is provided on either or both the inner layer on a perimeter outside the first panel or on the sealing panel which lies thereover, for adhering the sealing panel to the inner layer and the second panel. The sealing panel is releasable from the inner layer and separable from the second panel by pulling the sealing panel back in a peeling direction and reclosable against the top to seal the opening when the sealing panel is moved back against the top, whereby after closing, the second panel is separated from the outer layer.

In one form, the container includes a see through window portion formed in the sealing portion, adjacent the second panel, such that the second panel is viewable through the window portion, prior to the container being opened for a first time, thus indicating package integrity as not having being previously opened. After the container has been opened for a first time, and subsequently resealed, the absence of the second panel being adhered to the sealing panel will be observable through the window portion, thus indicating package integrity status as having been previously opened.

Food items disposable in the container may include cookies, crackers, peanuts, cheese, sliced meats and semi-solid foods.

Other features and advantages of the present invention are stated in or apparent from detailed descriptions of the presently preferred embodiments of the invention found hereinbelow.

DETAILED DESCRIPTION

Figure 1:
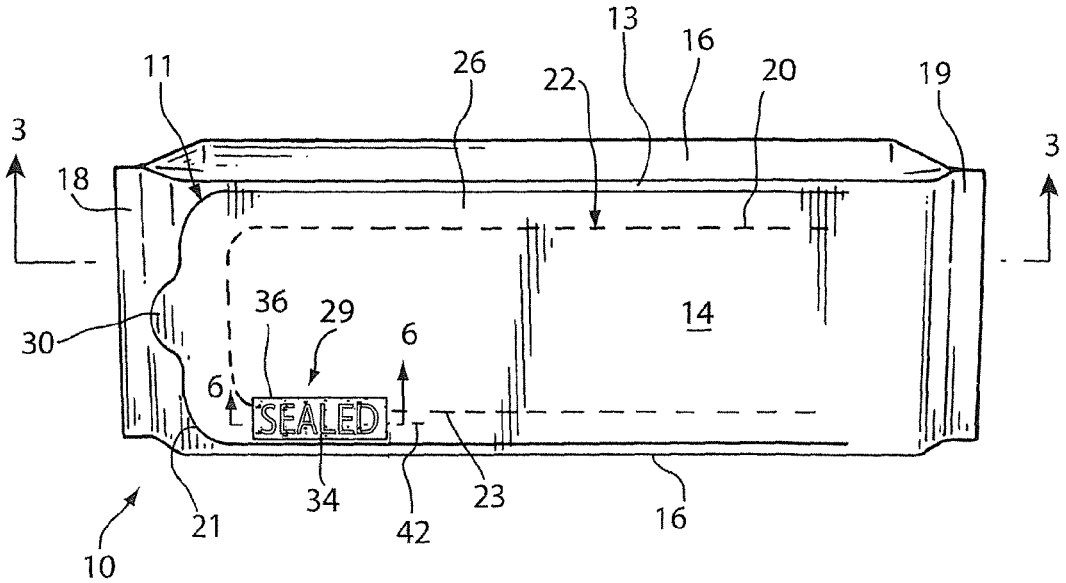
FIG. 1 is a perspective view of a package including an exemplary closure prior to an initial opening, according to the present invention.

Referring to the Figures, and in particular FIGS. 1-9, there is shown package 10 with closure 11 which incorporates a package integrity feature. Package 10 includes a two-ply wrapper comprising a first, inner film layer 12 and a second, outer film layer 13, forming a top or upper surface 14, sides 16, lower surface (not shown), and crimped ends 18, 19. The inner film layer 12 and outer film layer 13 are formed from a polymeric film or other flexible material that has been cut, folded or otherwise pressed to define an inner space or receptacle for receiving the desired product, such as food items, to be provided within the package 10. Package 10 can be used to store and distribute food items such as cookies, crackers, candy or other items. The outer film layer 13 may include graphics or other indicia to identify the contents of the package 10.

Advantageously, the inner film layer 12 is coextensively formed and adhesively joined to the outer film layer 13. During the manufacturing of the package 10, the first, inner film layer 12 is die cut on its side via first tear line 20 and second tear line 23, and outer film layer 13 is die cut on it side via a third tear line 21, as disclosed in U.S. Patent Application Publication No. 2005/0276525, herein incorporated by reference.

The first tear line 20 is formed as a continuous tear line to define a first panel 22. The second tear line 23 forms a second integrity indicating panel 42. The first panel 22 can be separated from the remainder of the inner film layer 12 to expose an opening 24 (FIG. 2*a* and FIG. 4), whereby access to the contents of the package 10 may be gained. The second panel 42 remains integrally joined to the inner film layer 12 at end 44, even after the package is opened, and the remainder falls down, only into the opening 24.

The third tear line 21 defines sealing panel 26 of the outer film layer 13. The sealing panel 26 extends beyond the periphery of the first tear line 20 and the second tear line 23 adjacent to the opening 24, so that the sealing panel 26 completely covers and extends beyond the perimeters of both the first panel 22 and the second panel 42. As a result, sealing portion 26 completely covers both the first panel 22 and the second panel 42.

The side of the sealing panel 26 which faces the inner film layer 12 is coated with a releasable adhesive 28 (see FIGS. 2*b*-5) so that the sealing panel 26 may be resealably secured to the inner film layer 12 at a portion adjacent the first panel 22. Alternatively or along with releasable adhesive 28, releasable adhesive can be coated on the inner film layer 12 along the outside perimeter of the first panel 22. The releasable adhesive can be any pressure sensitive adhesive which allows resealing and includes, but is not limited to, the adhesives disclosed in U.S. patent application Ser. No. 11/029,626, herein incorporated by reference. The sealing panel 26 is provided with a tab 30 or other gripping feature which is not coated with adhesive 28 so that the sealing panel 26 may be peeled back from the inner film layer 12 to open the package 10.

Advantageously, the sealing panel 26 has a see through window portion 29 which lies over the second panel 42 of the inner film layer 12 prior to the package 10 being opened for a first time. The see through window portion 29 is transparent or essentially transparent, thereby permitting one to visually observe the second panel 42 attached thereto prior to the package 10 being opened for a first time, and to observe the absence of second panel 42 attached to the sealing panel 26, after the package 10 has been opened, to indicate package integrity as disclosed in greater detail below.

Figure 3:
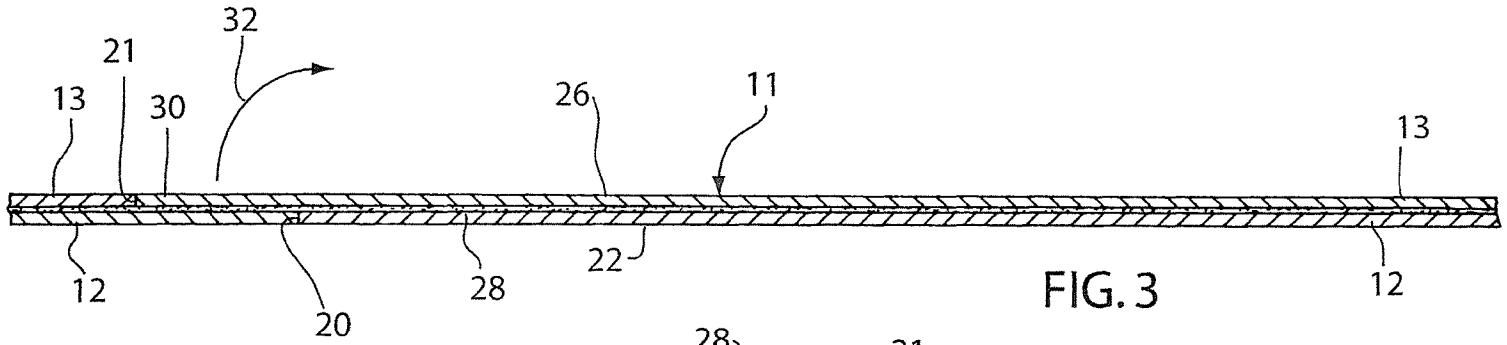
FIG. 3 is a cross-sectional view of the closure of FIG. 1, taken along line 3-3.
Figure 4:
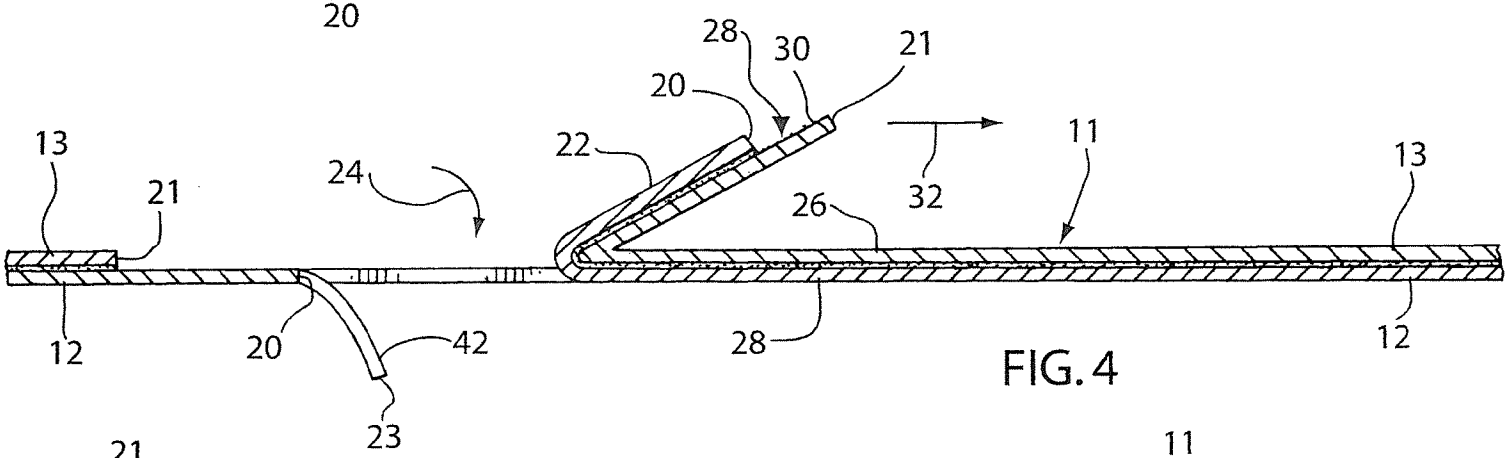
FIG. 4 is a cross-sectional view of the closure similar to FIG. 3, depicting an initial opening of the closure.
Figure 5:
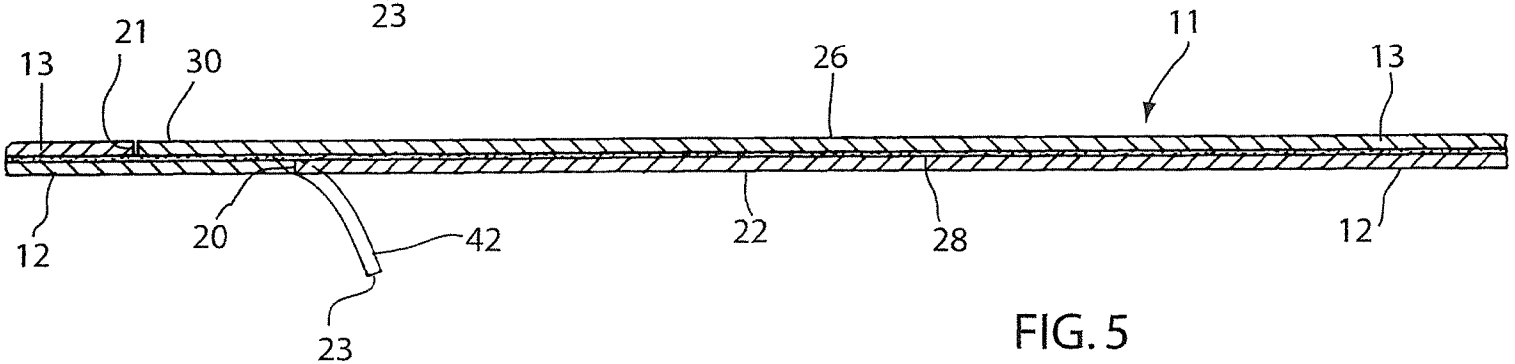
FIG. 5 is a cross-sectional view of the closure similar to FIG. 3, depicting a resealed configuration of the closure after the initial opening.
Figure 7:
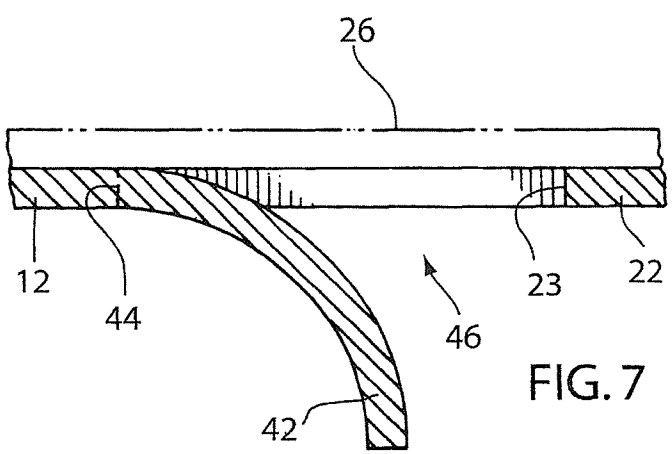
FIG. 7 is a cross-sectional view of the closure of FIG. 2*b*, taken along line 7-7.
Figure 6:
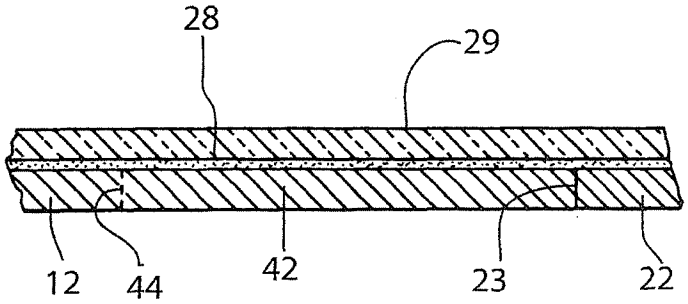
FIG. 6 is an enlarged cross-sectional view of the closure of FIG. 1, taken along line 6-6.
Figure 8:
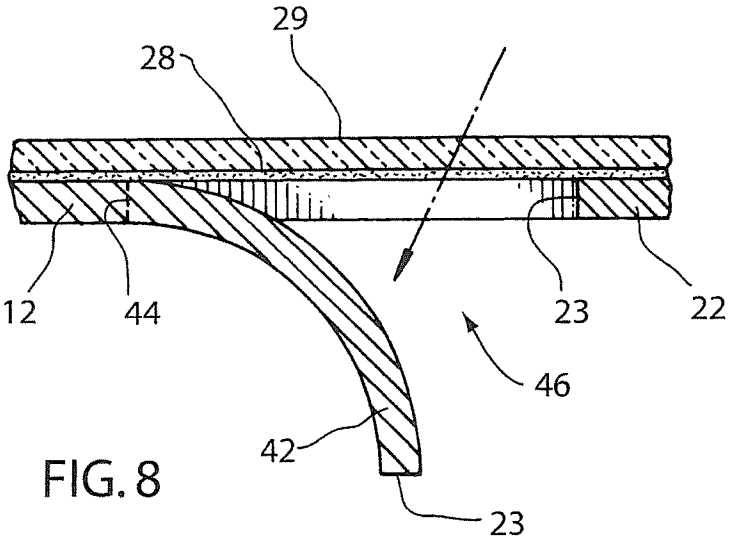
FIG. 8 is a cross-sectional view of the closure similar to FIGS. 6 and 7, depicting a resealed condition of the closure.

As shown in FIGS. 3 and 4, the first panel 22 is separated from the remainder of the inner film layer 12, including the second panel 42, along the first layer tear line 20 and second tear line 23, and remains adhered to the sealing panel 26 as the sealing panel 26 is peeled back in a peeling direction indicated by arrow 32 (FIGS. 2*a* and 4) to open the package 10. After the contents of the package have been accessed and it is desired to reseal the package 10, the sealing panel 26 may be reapplied to the inner film layer 12, approximately in its original position, as depicted in FIG. 5. Because the sealing panel 26 extends beyond the periphery of the first panel 22, the releasable adhesive 28 disposed thereon facilitates the resealing of the package 10 with the first panel 22 positioned over the access opening 24.

In addition, when the sealing panel 26 is peeled away from the inner film layer 12 to separate the first panel 22 for a first time, the second panel 42 is separated from the first panel 22 along second tear line 23. As previously noted, the second panel 42 remains integrally attached to the remainder of the inner film layer 12 at end 44 as the second panel 42 eventually becomes separated from the adhesive coated outer film layer 13 and, in particular, the sealing panel 26, as the sealing panel 26 is pulled back for a first time in direction 32. Referring to the schematic diagram of FIG. 9, as the sealing panel 26 is pulled back for a first time, the first tear line 20 tears successively, as indicated by the series of arrows 50, and the second tear line 23 tears successively as indicated by arrows 52 until the second tear line 23 terminates at the first tear line 20.

The second panel 42, prior to the package 10 being opened for the first time, is in the plane of the remainder of the inner film layer 12 and, thus, extends or is located in what will become the opening 24 after the package 10 is opened. Although the second panel 42 is shown abutting or adjacent to a side of the opening 24, the second panel 42 can be spaced from the sides of opening 24. After the package 10 has been opened for the first time, the second panel 42 falls away from the plane of the opening and inward toward the center or interior of the package 10.

Figure 2A:
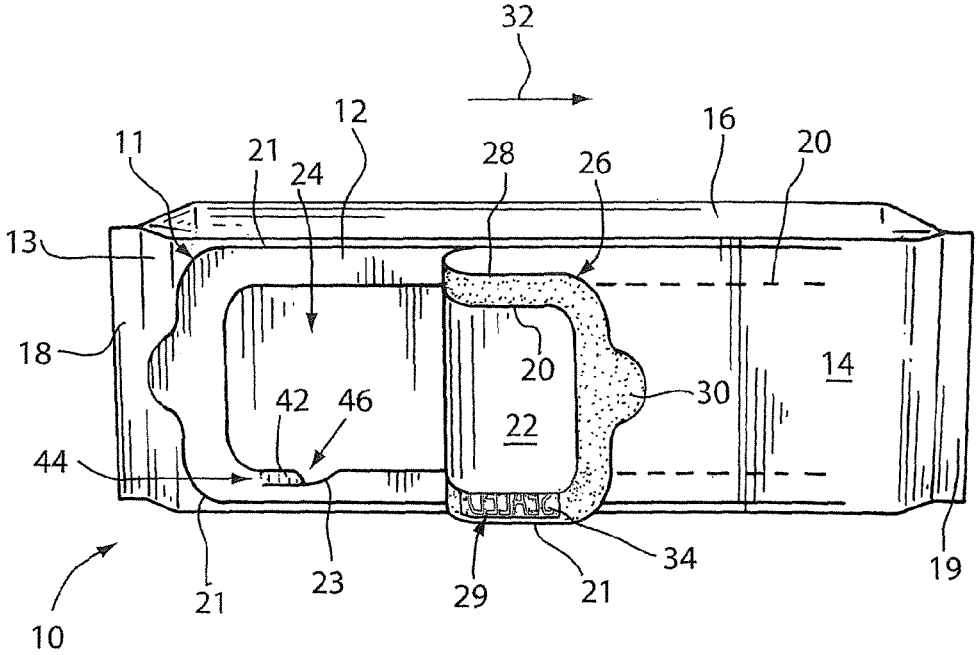
FIG. 2*a* is the package of FIG. 1, shown in a partially opened condition.
Figure 2B:
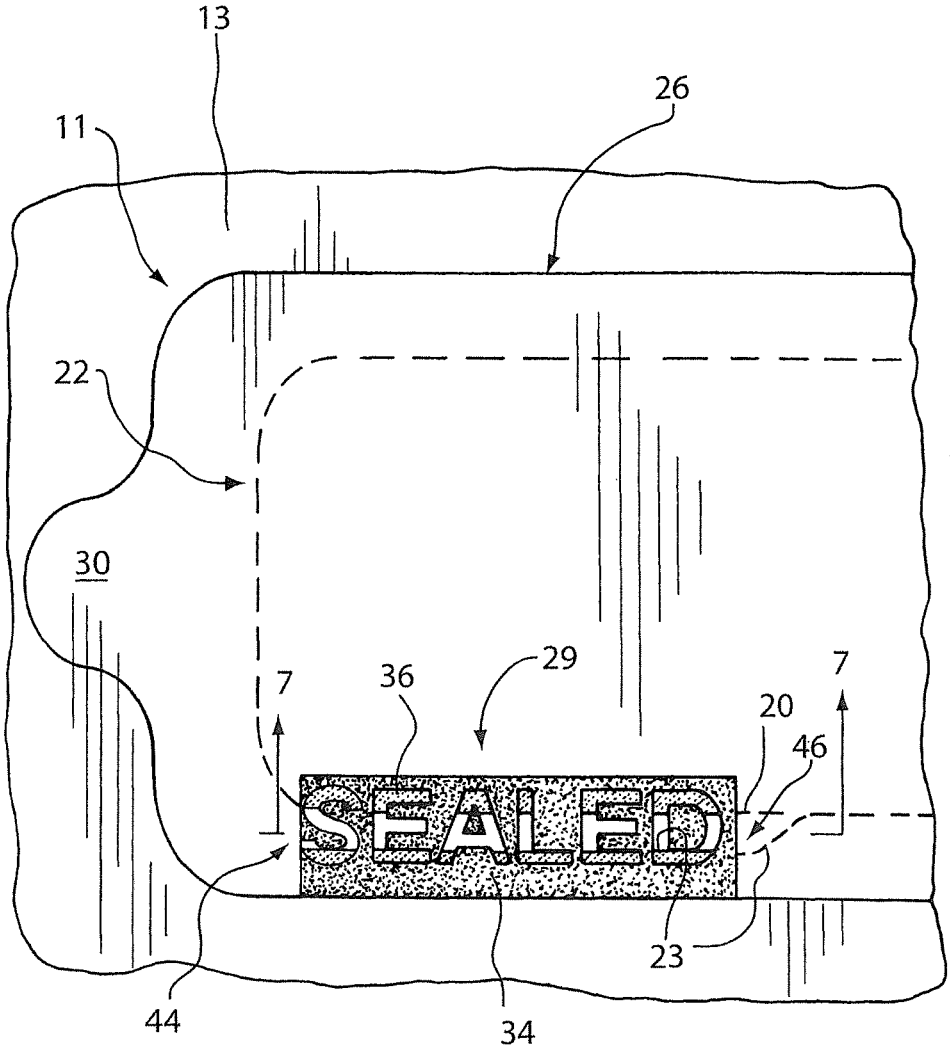
FIG. 2*b* is a partial enlargement of the package of FIG. 1, after the package has been opened and subsequently reclosed.

The second panel 42, along with the see through window portion 29, provides package integrity evidence in the form of a visual indication of an initial opening of the package 10, even after sealing panel 26 is resealed against the inner film layer 12 to reclose the package 10. The visual indication is provided by a portion 34 of the sealing panel 26, shown as black outlined letters for the word "SEALED," and a portion 36 of the inner film layer 12 spanning a portion of the first panel 22 and the second panel 42, shown as being gray which is viewable through the window portion 29, prior to the package 10 being opened for a first time, thus indicating package integrity status as not having been previously opened (FIG. 1). After package 10 has been opened, the second panel 42 will fall into the package 10 while remaining joined to the inner film layer 12 at end 44. Subsequently, following the sealing panel 26 being resealed to the inner film layer 12, over opening 24, void area 46 is viewable as the absence of gray shaded portion 36 observed through the window portion 29, thus indicating package integrity status as having been previously opened (FIG. 2*b*). As a result, the middle portion of the word "SEALED" at void 46 will not be shaded as shown in FIG. 2*b*.

Although portion 36 is depicted and described herein as being gray, it will be clear to one of ordinary skill in the art that the portion 36 as well as the rest of the inner layer 12, can be any color or shade. Further, although the second panel 42 is depicted and described as having dimensions which permit the second panel 42 to lie underneath only the middle portion of the word "SEALED" printed on the sealing panel 26, the second panel 42 could have dimensions which allow the word "SEALED" to lie completely over a relatively larger, second panel, so that after the package has been opened and subsequently resealed, the entire word "SEALED" will be over a relatively larger void area than void area 46, and thus, only the outline of the word "SEALED" will be visible, but the letters themselves will have no part which is shaped or colored.

In addition, although the portion 34 is depicted and described as having the outline of the word "SEALED" formed therein, alternative words, e.g. "UNOPENED" may be substituted. In a further alternative, rather than a word, the portion 34 may be a geometric shape, such as a rectangle, square or circle, which appears filled or solid, prior to the package being opened for a first time, and appears partially or fully voided or unfilled after the package has been opened and subsequently resealed.

While FIGS. 1-9 show and describe closure 11 as forming the opening of a wrapper which defines package 10, the closure 11 may form a top surface of other packages having resealable openings such as those disclosed in U.S. patent application Ser. No. 11/193,613, herein incorporated by reference, and, thus, closure 11 can form a closure over a thermoform tray having a sealing panel 26 as a lidding material over the top of the tray.

Figure 10:
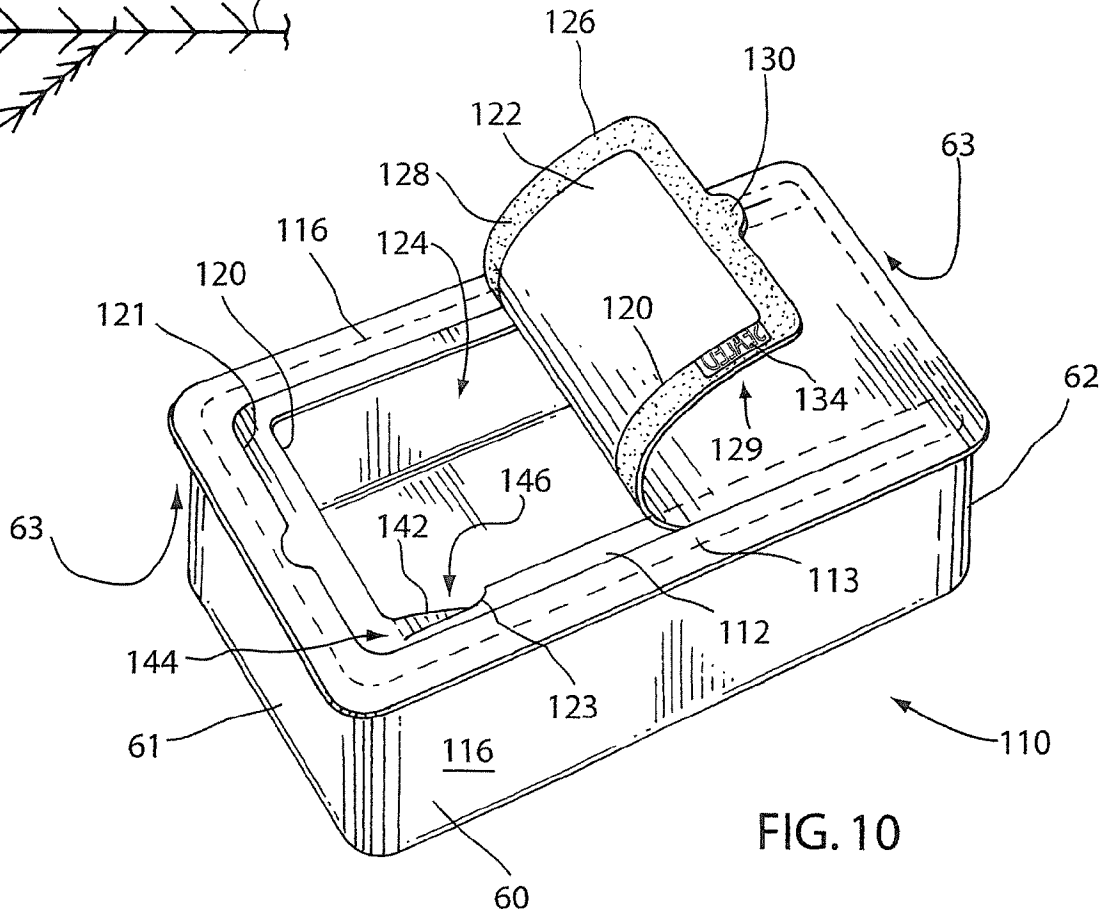
FIG. 10 is a perspective view of another package, including a closure that has been opened, in accordance with the present invention.
Figure 9:
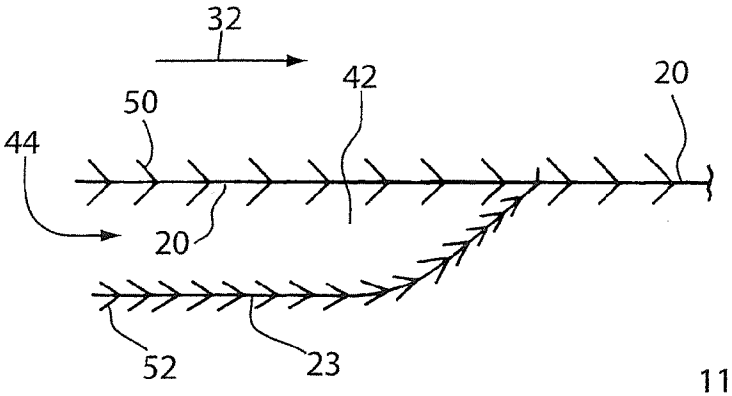
FIG. 9 is a schematic diagram showing the separation of the package integrity feature from the package of FIG. 1, in accordance with the present invention.

Although second panel 42 is depicted and described as being formed in the inner film layer 12 by the first tear line 20 and the second tear line 23, alternatively, a third tear line can be formed in the inner film layer 12 so that the second panel is completely spaced from the opening at the tab portion end of the package as disclosed in the embodiment of FIGS. 10*a* and 10 be of U.S. patent application Ser. No. 11/438,706.

Referring to FIG. 10, like elements to those of the embodiment of FIGS. 1-9 are increased by 100. Package 110 comprises a thermoform tray 60 which forms the sides 116 and ends 61, 62. A two-ply film material comprising an inner film layer 112 and outer film layer 113 are sealed to flange 63 of the thermoform tray 60. Like package 10, pulling back on tab 130 separates the sealing panel 126 from the outer film layer 113 and separates the first panel 122 from both the inner film layer 112 and the second panel 142.

As with package 10, package 110 has a see through window portion 129 formed in the sealing panel 126, lying adjacent or over the second panel 142, such that the second panel 142 is viewable through the window portion 129, prior to package 110 being opened for a first time, thus indicating package integrity as not having being previously opened. After package 110 has been opened for a first time, and subsequently resealed, the absence of the second panel 142 being adhered to the sealing panel 126 will be observable through the window portion 129, thus indicating package integrity status as having been previously opened.

Package 110 can be used for various food items, such as cheese, sliced meats and the like. In addition, package 110 can be used for semi-solid items, such as pudding and yogurt. Although package 110 is depicted as having a rectangular shape, the package 110 can have any shape, including cylindrical and irregular.

The inner and outer film layers 112, 113 may be formed of the same material as layers 12, 13, which includes polypropylene, polyethylene, cellophane or any other polymeric material suitable for forming a package enclosure.

As will be apparent to one of ordinary skill in the art that the present package integrity feature of the present closure offers benefits over prior tamper-evident or package integrity features.

The invention claimed is:

1. A package comprising:

a film material with a resealable closure, the film material having at least a first layer and a second layer;

a first cut formed into one layer of the at least two-layer film material forming, at least in part, an opening into the package to provide access to at least one item disposed in the package, the first cut defining at least in part an access panel that is peelable upward to expose the opening;

a second cut formed into the first layer of the at least two-layer film material, the second cut extending transversely from the first cut, the second cut forming, at least in part, an integrity indicating panel displaced from a plane of the first layer upon initial opening; and a window disposed in the film material permits visible inspection of the integrity indicating panel.

2. The package of claim 1 wherein the first cut is formed into the first film layer and the second layer is disposed over the first layer.

3. The package of claim 2 wherein the window is disposed in the second layer and lies over the integrity panel prior to initial opening.

4. The package of claim 3 wherein the window is at least substantially transparent.

5. The package of claim 1 further comprising an adhesive disposed between at least portions of the first and second layers to provide the resealable closure.

6. The package of claim 1 wherein the integrity indicating panel remains attached to the package subsequent to initial opening.

7. The package of claim 1 further comprising multiple second cuts forming multiple integrity indicating panels.

8. The package of claim 1 further comprising a sealing panel formed, at least in part, by the first cut, the sealing panel having a graspable tab permitting a user to peel back the sealing panel to expose the package opening.

9. A package comprising:

a film material having at least a first film layer adhesively joined to a second film layer;

a tray having the at least two-layer film material wrapped at least partially around the tray to form an outer surface of the package;

a first cut formed into one layer of the at least two-layer film material, the first cut forming, at least in part, an opening into the package to provide access to food items disposed in the package, the first cut defining at least in part an access panel that is peelable upward to expose the opening; and a plurality of second cuts formed into the one layer of the at least two-layer film material, the second cuts extending transversely from the first cut, the second cuts forming, at least in part, tamper indicators, the tamper indicators configured to be displaced from a plane of the at least two-layer film material upon initial opening to provide a visual indication that the package has been opened, the tamper indicators formed are disposed adjacent the access panel prior to initial package opening such that the tamper indicators and the access panel are contiguous with one another prior to the initial package opening; and a window disposed in the film material permits visible inspection of the tamper indicators.

10. The package of claim 9 wherein a top of the package includes peripheral graphics disposed outside the opening and the access panel includes graphics thereon and wherein the peripheral graphics and the panel graphics align with one another prior to initial opening of the package.

* * * * *